US007550687B2

(12) United States Patent
Su

(10) Patent No.: US 7,550,687 B2
(45) **Date of Patent: *Jun. 23, 2009**

(54) ARCHITECTURE EFFECTIVELY CONNECTING A ROTARY SWITCH AND A CASING

(75) Inventor: Tsui-Jung Su, Taipei Hsien (TW)

(73) Assignee: Zippy Technology Corp., Taipei Hsien (TW)

( * ) Notice: Subject to any disclaimer, the term of this patent is extended or adjusted under 35 U.S.C. 154(b) by 5 days.

This patent is subject to a terminal disclaimer.

(21) Appl. No.: 11/406,313

(22) Filed: Apr. 19, 2006

(65) Prior Publication Data

US 2007/0246332 A1 Oct. 25, 2007

(51) Int. Cl.
*H01H 19/11* (2006.01)
*H01H 19/58* (2006.01)

(52) U.S. Cl. ..... 200/11 R; 200/336

(58) Field of Classification Search ..... 200/11 R
See application file for complete search history.

(56) References Cited

U.S. PATENT DOCUMENTS 5,369,230 A * 11/1994 Misawa ..... 200/52 R
6,294,746 B1 * 9/2001 Yee ..... 200/565
6,506,984 B2 * 1/2003 Tomita ..... 200/11 R
6,621,016 B2 * 9/2003 Ohba et al. ..... 200/4
6,972,386 B1 * 12/2005 McSwiggen ..... 200/11 R
7,091,437 B2 * 8/2006 Yeh et al. ..... 200/571
7,145,087 B1 * 12/2006 Su et al. ..... 200/4

FOREIGN PATENT DOCUMENTS

TW 252616 A 7/1995

* cited by examiner

*Primary Examiner*—Elvin G Enad
*Assistant Examiner*—Lheiren Mae A Anglo
(74) *Attorney, Agent, or Firm*—Muncy, Geissler, Olds & Lowe, PLLC

(57) ABSTRACT

An architecture effectively connecting a rotary switch and a casing comprises: a rotary switch and a casing that is engaged with the rotary switch via a rotary disc of the rotary switch. The casing has multiple snap-fit parts corresponding to snap-fit slots of the rotary disc to form a snap-fit interconnection therebetween. When the casing is rotated, the casing will drive the rotary switch to rotate via the interconnection between the snap-fit parts and the snap-fit slots, and a signal module will output instructions corresponding to the rotation track of the rotary disc. The interconnection between the casing and the rotary disc is implemented with a snap-fit method, and the rotated casing drives the rotary disc to rotate synchronically and create signals. As the casing is engaged with the rotary disc via a snap-fit method, the casing is hard to deviate or loosen. Thus, correct instructions will be exactly output.

7 Claims, 3 Drawing Sheets

ARCHITECTURE EFFECTIVELY CONNECTING A ROTARY SWITCH AND A CASING

FIELD OF THE INVENTION

The present invention relates to a rotary switch, particularly to an architecture effectively connecting a rotary switch and a casing.

BACKGROUND OF THE INVENTION

As to the conventional rotary switches, R.O.C Patent Publication No. 252616 discloses an "improved rotary switch structure", wherein a rotary axle is installed inside a casing; the upper end of the rotary axle is pressed to engage with an operational knob; an electrically-conductive element is also pressed to engage with the rotary axle at an appropriate position near the lower end thereof; the lower end of the rotary axle is also engaged with a disc, which can be fixed to the casing with screws; a common terminal and multiple contact terminals are installed at appropriate positions of the disc; two protrusions of the electrically-conductive element can respectively contact the common terminal and one of the contact terminals. When such a rotary switch is used to control the rotation speed of an electric fan, a power wire is connected to the common terminal, and the wires for controlling different rotation speeds (such as low, middle, and high speeds) are respectively connected to those contact terminals of the disc. The user rotates the operational knob, and the operational knob drives the rotary axle to actuate the protrusions of the electrically-conductive element to respectively contact the common terminal and one of the contact terminals of the disc. Thus, the electric fan is turned on, and the rotation speed thereof is also determined. However, the abovementioned rotary switch has the following disadvantages:

1. The connection between the upper end of the rotary axle and the operational knob is implemented with merely a press engagement and lacks a secured mechanism. Between the operational knob and the rotary axle may exist a gap, which may deviate the operational knob and cause that the user cannot rotate the operational knob or the rotary switch may output a wrong instruction.
2. The press action may distort or fracture the operational knob, and may also damage the internal electrically-conductive element.
3. After a long-term usage, abrasion will enlarge the gap and loosen the engagement between the rotary axle and the operational knob. Therefore, when the user rotates the operational knob, the operational knob is likely to rotate ineffectually; thus, the rotary axle may be incorrectly actuated, and a wrong instruction may be created.

Therefore, the conventional rotary switch still has much room to improve.

SUMMARY OF THE INVENTION

The primary objective of the present invention is to utilize a snap-fit method to connect a rotary switch and a casing so that the casing can be securely engaged with the rotary switch lest the gap and abrasion influence the driving of the rotary switch and so that the problems of the conventional rotary switch can be effectively solved.

To achieve the abovementioned objective, the present invention comprises a rotary switch, and the rotary switch further comprises a base and a rotary disc that is engaged with the base and can rotate with respect to the base. An accommodation space is formed between the rotary disc and the base for a signal module. The signal module outputs instructions corresponding to the rotation track of the rotary disc. A casing is disposed above the rotary switch and engaged with the rotary disc. The casing has multiple snap-fit parts corresponding to snap-fit slots of the rotary disc to form a snap-fit interconnection therebetween. When the casing is rotated, the casing will actuate the rotary switch to rotate via the interconnection between the snap-fit parts and the snap-fit slots. Thereby, the rotated casing can drive the rotary disc to rotate synchronically and create signals. As the casing is engaged with the rotary disc via a snap-fit method, the assemblage structure of the rotary switch and the casing is secured, and the casing is hard to deviate or loosen, and thus, correct instructions will be exactly output.

BRIEF DESCPRIPTION OF THE DRAWINGS

DETAILED DESCRIPTION OF THE PREFERRED EMBODIMENTS

The technical contents of the present invention are to be described in detail in cooperation with the drawings below.

Figure 1:
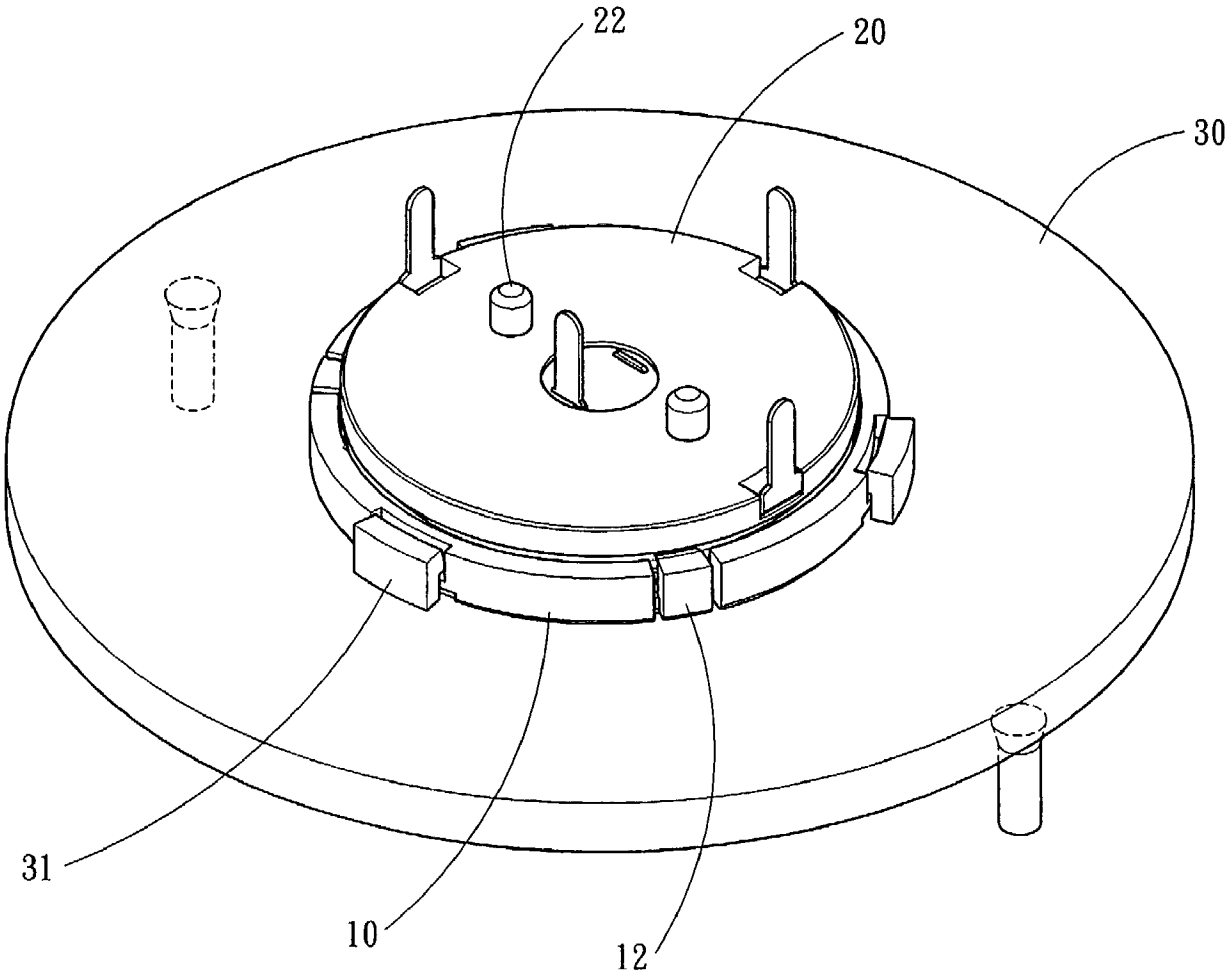
FIG. 1 is a diagram showing a perspective view of the appearance of the present invention.
Figure 2:
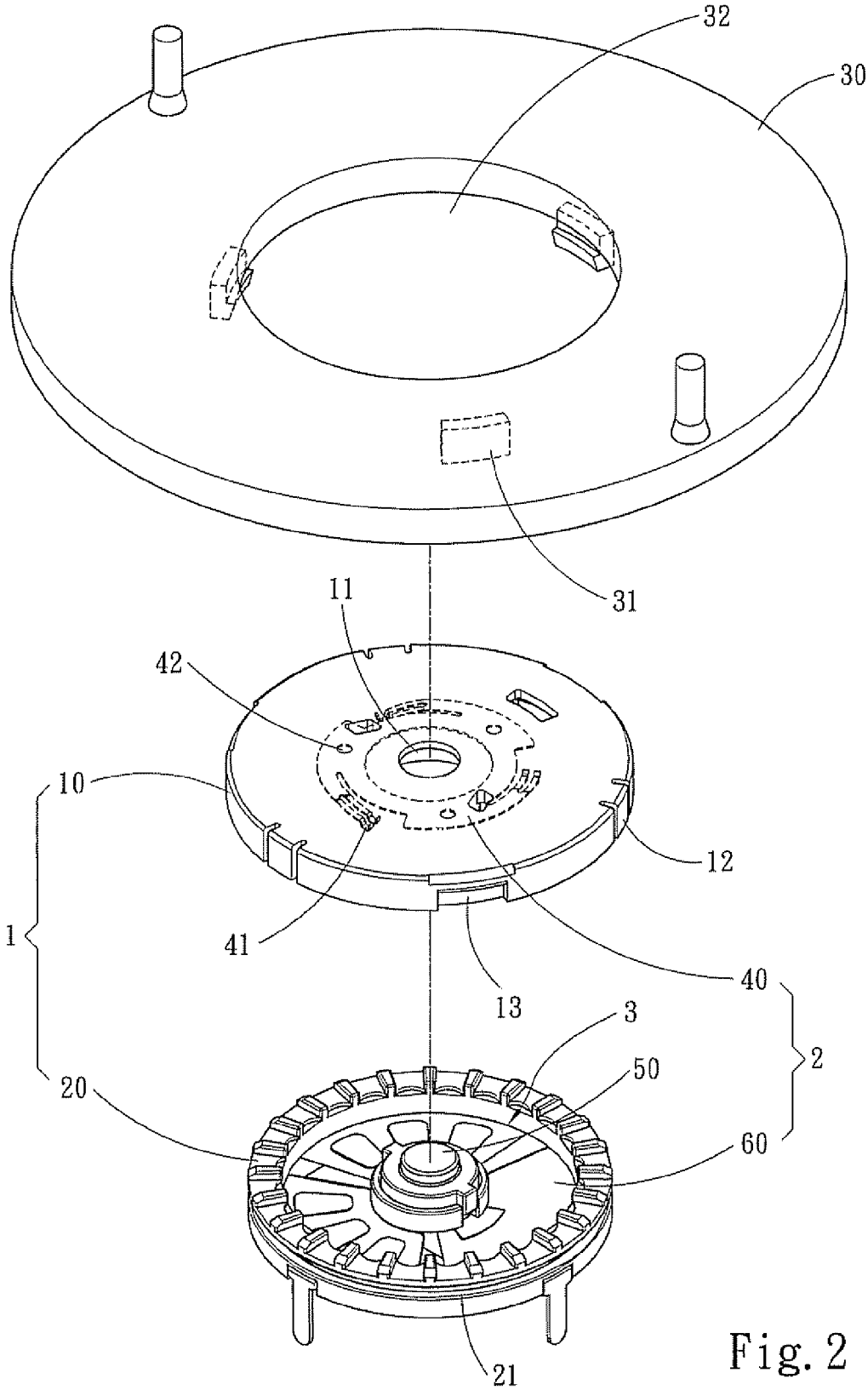
FIG. 2 is a diagram showing an exploded view of the present invention.
Figure 3:
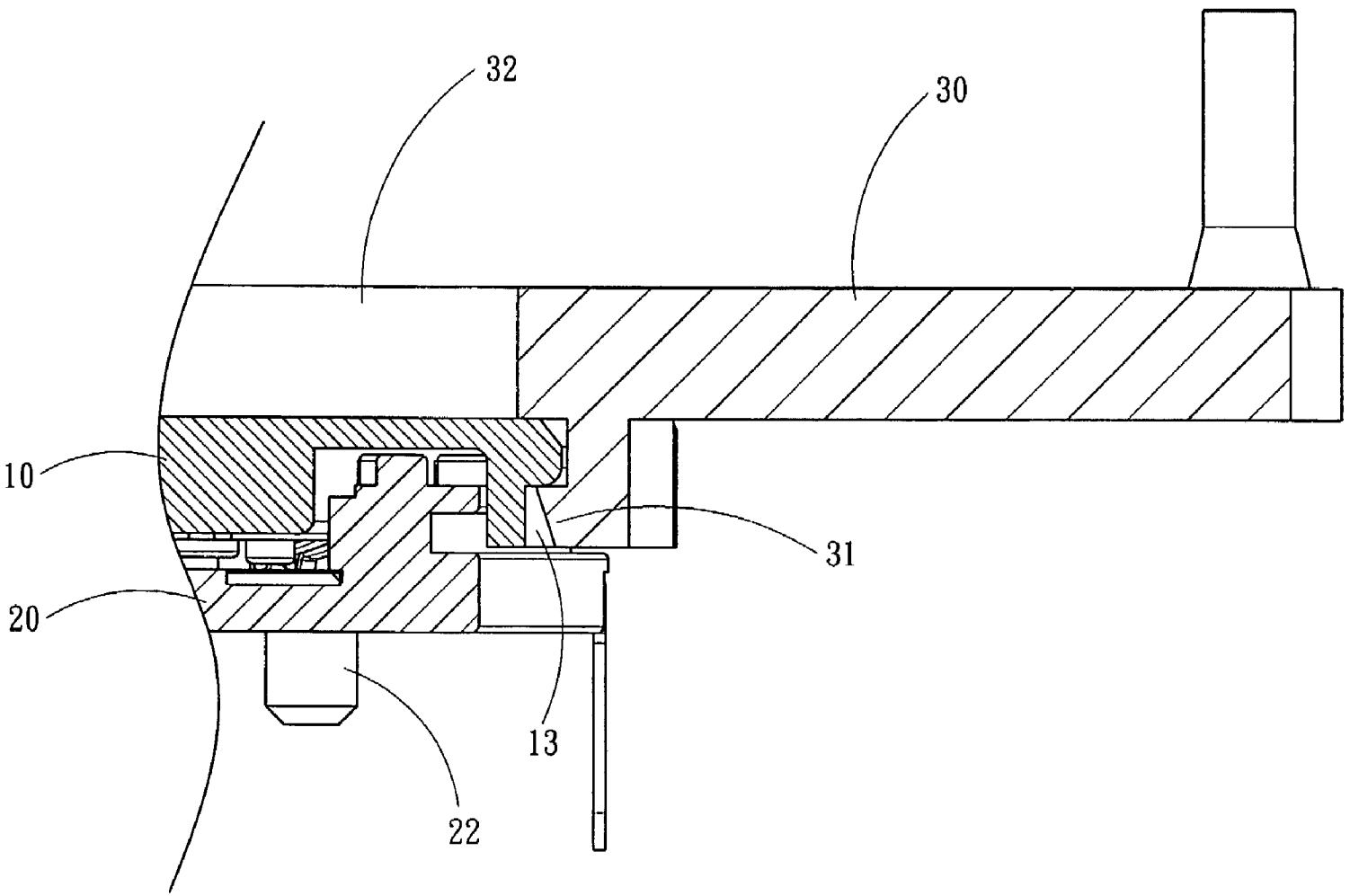
FIG. 3 is a diagram showing a sectional view of the present invention.

Refer to FIG. 1, FIG. 2 and FIG. 3 respectively showing an appearance perspective view, an exploded view, and a sectional view of the present invention. The present invention comprises a rotary switch 1, and the rotary switch 1 further comprises a base 20 and a rotary disc 10, which is engaged with the base 20 and can rotate with respect to the base 20. The perimeter of the rotary disc 10 has multiple snap-fit parts 12, which can be pulled up to assemble the rotary disc 10 to the top of the base 20. The perimeter of the base 10 has an annular trench 21, and the snap-fit parts 12 of the rotary disc 10 hook the annular trench 21, and the rotary disc 10 can be rotated with respect to the base 20 with the annular trench 21 being the track. An accommodation space 3, which contains a signal module 2, is formed between the rotary disc 10 and the base 20. The signal module 2 further comprises: an electrically-conductive element 40 and a contact terminal set 60 disposed on the base 20. When the rotary disc 10 is rotated, the signal module 2 outputs a corresponding instruction. The rotary switch 1 is engaged with a casing 30. The casing 30 has multiple snap-fit parts 31, and the rotary disc 10 has snap-fit slots 13 corresponding to the snap-fit parts 31 to form a snap-fit interconnection therebetween. The snap-fit slots 13 are disposed along the perimeter of the rotary disc 10, wherein some appropriate locations of the perimeter of the rotary disc 10 are concaved inwards to form the snap-fit slots 13. The snap-fit parts 31 and the snap-fit slots 13 are respectively disposed on the casing 30 and the rotary disc 10 and separated by an identical angle. The external diameter of the casing 30 is greater than that of the rotary disc 10. The casing 30 has a through-hole 32, and the snap-fit parts 31 are disposed at the positions around the perimeter of the through-hole 32 and corresponding to the snap-fit slots 13. When the casing 30 is rotated, the snap-fit parts 31 will drive the rotary switch 1 to rotate via the interconnection between the snap-fit parts 31 and the snap-fit slots 13. The transverse distance of the snap-fit slots 13 may be greater than that of the snap-fit parts 31 so that there will be a gap functioning as a buffer when the user operates the rotary switch 1. The top of the rotary disc 10 further has an installation hole 11 to accommodate a press-button module 50, and pressing the press-button module 50 will generate a corresponding instruction. The press-button module 50 is disposed in the position corresponding to the through-hole 32. The bottom of the base 20 also has multiple fixing parts 22, via which the rotary switch 1 can be fixed to a related equipment. In this preferred embodiment, the contact of the electrically-conductive element 40 and the contact terminal set 60 of the signal module 2 forms a complete loop. The electrically-conductive element 40 is assembled to the bottom of the rotary disc 10 via multiple assembling holes 42, and thus, the rotating rotary disc 10 can drive the electrically-conductive element 40 to rotate synchronically. Multiple contact arms 41 extend from the electrically-conductive element 40 and are used to contact the contact terminal set 60. When the contact arms 41 are pressed, a downward elastic force will restore the contact arms 41 to their original positions. However; in the present invention, the structure and installation method of the signal module 2 are not limited to those mentioned above or those shown in the drawings but may have various embodiments.

Summarily to speak, in the present invention, a casing 30 is installed above the rotary disc 10, and the casing 30 has a through-hole 32 corresponding to the rotary disc 10; multiple snap-fit parts 31 are disposed around the perimeter of the through-hole 32, and the snap-fit parts 31 can be snap-fitted to the snap-fit slots 13 of the rotary disc 10. Thereby, when the user rotates the casing 30, the casing 30 can firmly drive the rotary disc 10 to rotate synchronically, and the signal module 2 can generate a corresponding signal. As the casing 30 is engaged with the rotary disc 10 via a snap-fit method, the casing 30 is hard to deviate or loosen, and the ineffectual rotation or wrong instructions can be effectively avoided.

The present invention has been clarified via the preferred embodiments described above; however, it is not intended to limit the scope of the present invention; any equivalent modification and variation according to the spirit of the present invention is to be also included within the scope of the present invention. As the technical characteristics of the present invention have not been published before, the present invention undoubtfully possesses novelty. Further, in view of those stated above, the present invention also really possesses utility and non-obviousness. Thus, the present invention meets the requirements for applying a patent. Therefore, the inventors file the patent application of the present invention. It will be greatly appreciated by the inventors that the patent of the present invention can be rapidly approved and licensed.

What is claimed is:

1. An architecture effectively connecting a rotary switch and a casing, comprising:

a rotary switch, further comprising a base and a rotary disc said base having an annular trench along an outer perimeter and said rotary disc having a plurality of first snap-fit parts along an outer perimeter, said first-snap fit parts being engaged with said annular trench, so that said rotary disc can rotate with respect to said base, with an accommodation space formed between said rotary disc and said base for a signal module that outputs instructions corresponding to a rotation track of said rotary disc; and a casing, engaged with said rotary switch, having a plurality of second snap-fit parts corresponding to snap-fit slots of said rotary disc to form a snap-fit interconnection therebetween, and able to drive said rotary switch to rotate via the interconnection between said second snap-fit parts and said snap-fit slots said second snap fit parts being no thicker than the rotary disc the casing having two main flat surfaces parallel to each other with the rotary switch being mounted against one of said main flat surfaces;

wherein said snap-fit slots are disposed along the perimeter of said rotary disc, and some appropriate locations of the perimeter of said rotary disc are concaved inwards to form said snap-fit slots; and wherein the external diameter of said casing is greater than that of said rotary disc said casing has a through-hole, and said second snap-fit parts are disposed at the positions around the perimeter of said through-hole and corresponding to said snap-fit slots.

2. The architecture effectively connecting a rotary switch and a casing according to claim 1, wherein said second snap-fit parts and said snap-fit slots are respectively disposed on said casing and said rotary disc and separated by an identical angle.

3. The architecture effectively connecting a rotary switch and a casing according to claim 1, wherein the transverse distance of said snap-fit slots is greater than that of said second snap-fit parts so that a gap will be formed in the connection location.

4. The architecture effectively connecting a rotary switch and a casing according to claim 1, wherein said rotary switch further has a press-button module, and said press-button module is disposed in the position corresponding to said through-hole; pressing said press-button module will generate a corresponding instruction.

5. The architecture effectively connecting a rotary switch and a casing according to claim 1, wherein the base includes fixing parts to connect that base to a board.

6. The architecture effectively connecting a rotary switch and a casing according to claim 1, wherein the accommodation space receives a complete signal module.

7. The architecture effectively connecting a rotary switch and a casing according to claim 1, wherein the external diameter of the casing is greater than a diameter of said snap-fit parts while a diameter of said rotary disc is no greater than the diameter of said snap-fit parts.

* * * * *